United States Patent [19]

Pibernat

[11] 4,397,293

[45] Aug. 9, 1983

[54] HEATING APPARATUS COMPRISING A HEAT RECOVERY APPARATUS

[76] Inventor: Thierry Pibernat, Route de Saint Memy, 81300 Graulhet, France

[21] Appl. No.: 266,079

[22] Filed: May 21, 1981

[30] Foreign Application Priority Data

May 21, 1980 [FR] France ..... 80 11742

[51] Int. Cl.[3] ..... F24B 5/00

[52] U.S. Cl. ..... 126/69; 126/76; 126/121; 126/143; 165/DIG. 2

[58] Field of Search ..... 126/69, 72, 74, 76, 126/70, 77, 67, 61, 63, 66, 121, 126, 99 A, 109, 106, 163 R, 103; 165/DIG. 2; 237/55

[56] References Cited

U.S. PATENT DOCUMENTS

| | | | |
|---|---|---|---|
| 12,382 | 2/1855 | Easterly | 126/76 |
| 86,074 | 1/1869 | Newton | 126/76 |
| 574,210 | 12/1896 | McLean | 126/76 |
| 661,257 | 11/1900 | Brooke | 126/76 |
| 839,804 | 1/1907 | Ayres | 126/76 |
| 843,103 | 2/1907 | Roell | 126/76 |
| 843,105 | 2/1907 | Roell | 126/69 |
| 4,153,036 | 5/1979 | Billmeyer | 126/121 |
| 4,193,387 | 3/1980 | Cline | 126/121 |
| 4,263,889 | 4/1981 | Martenson | 126/121 |
| 4,271,815 | 6/1981 | Johnson | 126/143 |

FOREIGN PATENT DOCUMENTS

| | | |
|---|---|---|
| 981771 | 5/1951 | France . |
| 982015 | 6/1951 | France . |
| 1016208 | 11/1952 | France . |
| 2314443 | 1/1977 | France . |
| 575813 | 3/1946 | United Kingdom . |

*Primary Examiner*—Daniel J. O'Connor
*Attorney, Agent, or Firm*—Sandler & Greenblum

[57] ABSTRACT

A heating apparatus includes at least one combustion air inlet, a reverse-draft hearth having a grill positioned within a hearth plate, an ash receptacle for recovering combustion wastes, a fume outlet, a combustion chamber positioned under the reverse-draft hearth, and a heat recovery device. A heat transport and exchange fluid is adapted to be fed through the heat recovery device, and it circulates through the device in order to recover heat generated in the hearth. The heat recovery device also includes at least one casing positioned beneath the hearth, over the ash receptacle, and which is spaced from the walls of the heating apparatus. The rear portion of the casing is connected to the hearth plate so as to block combustion gases so that the combustion gases will pass over and thereafter under the casing prior to leaving the apparatus via the fume outlet.

15 Claims, 4 Drawing Figures

HEATING APPARATUS COMPRISING A HEAT RECOVERY APPARATUS

BACKGROUND OF THE INVENTION

1. Field of the Invention

The present invention relates to a heating device comprising a heat recovery apparatus.

2. Description of Prior Art

Heating apparatus are known which comprise a combustible air inlet and a hearth, under which is disposed a combustion chamber provided with an evacuation conduit for burnt gases or fumes.

In this type of equipment, the combustion of the combustible occurs downwardly, which makes it possible to burn a large portion of the gas given off, thus avoiding any tar or other deposit in the evacuation conduit. The complete combustion of the combustible gas makes it possible to substantially increase the heat yield of such apparatus. As a result of its design, this type of equipment can heat only the room where it is situated, and cannot for example, constitute a source of heat for use in a central heating system.

Likewise, heating systems are known which have an open hearth, such as fireplaces, which are equipped with heat recovery apparatus in order to increase their heat yield. Present heat recovery apparatus in fireplaces are positioned at the level of the hearth or around it, in the rear of the fireplace, and in the hood of the smoke evacuation conduit. During combustion, the solid combustible material gives off combustible gases which, in order to themselves burn, must be brought to an elevated temperature which is incompatible with this type of equipment. These unburned gases deposit by condensing in the evacuation conduit and on the heat recovery apparatus mounted in the hood which eventually results in a draft reduction and reduced heat yield. Furthermore, in order to assure a correct draft, smoke must be maintained at a sufficient temperature during its evacuation and loses a small portion of its heat, which limits the ease of recovery of known heat exchangers.

SUMMARY OF THE INVENTION

The present invention has for an object to overcome the disadvantages as recited above by providing an improved heating apparatus.

BRIEF DESCRIPTION OF THE DRAWINGS

The invention is hereinafter explained in detail, according to a preferred embodiment, with reference to the annexed drawings in which.

DETAILED DESCRIPTION OF THE DRAWINGS

Figure 1:
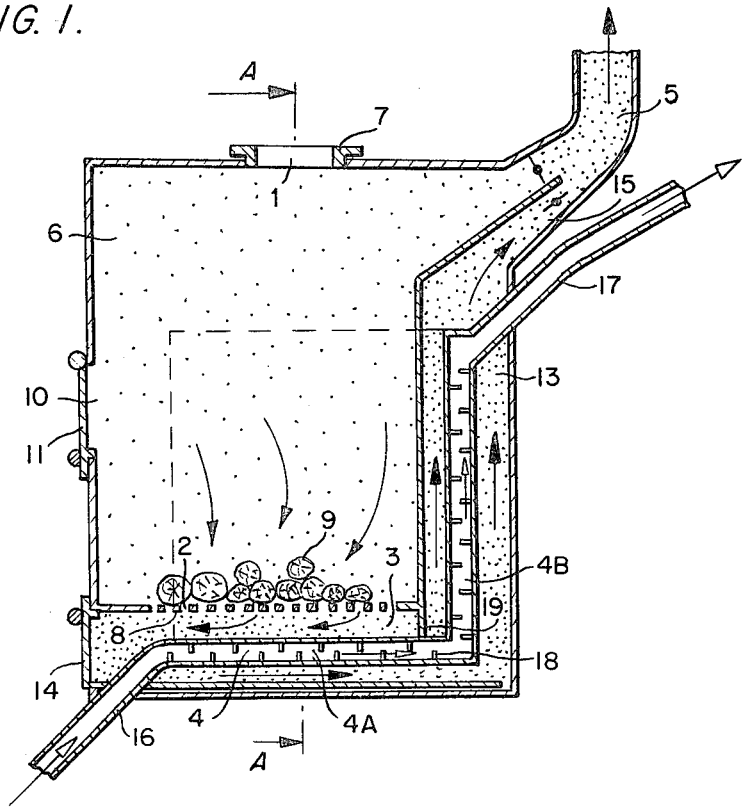
FIG. 1 is a schematic view, in cross-section, of a heating apparatus according to the invention.

As shown, the heating apparatus according to the invention comprises at least one combustion air inlet 1 and, a hearth 2 under which is positioned a combustion chamber 3, which receives a heat recovery apparatus 4.

The gases burned in chamber 3 are evacuated through at least one conduit 5.

As can be seen from examination of FIGS. 1 and 2, the apparatus according to the invention is of the type which receives a solid combustible, but it is clear that the provisions described below can be equally well applied to heating apparatus having liquid or gaseous combustibles, or to heating apparatus of the mixed combustible type.

The heating apparatus such as shown in FIG. 1 comprises a combustion air inlet positioned at its upper portion. This inlet opens into a large capacity container 6 and can be partially or totally obstructed by a plate 7 so as to adjust the flow of combustion air. Hearth 2 is provided with a grille 8 allowing for the communication of the enclosure 6 with the combustion chamber 3. Solid combustible 9 is positioned on the grill and is introduced into the apparatus through an opening 10, positioned above the hearth, which is provided with a pivotable closing damper 11. In its lower portion and in combustion chamber 3 the heating apparatus is provided with an ash receptacle 14, mounted on slides 12, for receiving combustion wastes.

Between at least one of the walls of the container and one of the walls of the heating apparatus a space 13 is provided which opens the combustion chamber 3 and which is provided in its upper portion with a line 15, connected to smoke evacuation conduit 5, which is itself also connected to enclosure 6. In combustion chamber 3 and in space 13 the heat recovery apparatus 4 is mounted in this apparatus is located a heat exchange fluid for recovering the heat leaving the combustion and for releasing the heat to a heating station. To allow for the draft of the apparatus from the hearth upwardly to the evacuation line 15, the heat recovery apparatus is mounted, with a sufficient clearance, within the combustion chamber and in the space 13. The recovery apparatus 4 is attached to the heating apparatus by any means known to one of skill in the art.

This recovery device comprises at least two connected casings 4A and 4B, which are positioned, respectively, in combustion chamber 3 and in space 13. Casing 4A, positioned between the ash receptacle 14 and hearth 2, is parallel or slightly inclined towards the ash receptacle so as to facilitate the evacuation of wastes leaving the hearth to the said ash receptacle. Casing 4A is provided at its free end with a line 16, through which heat exchange fluid such as gas or liquid is introduced. Casing 4B is provided at the upper end with a line 17 for permitting outflow of the heat exchange fluid.

Figure 2:
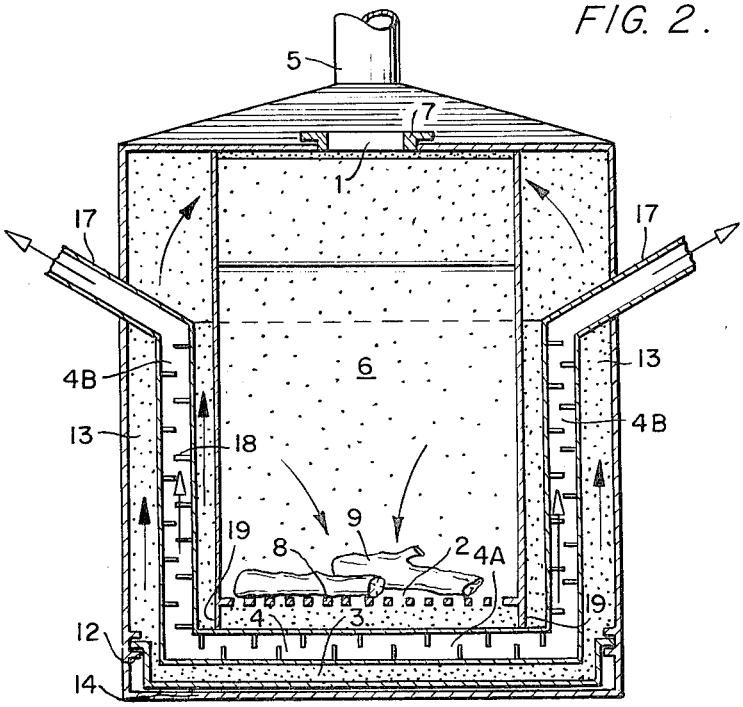
FIG. 2 is a schematic view, in cross-section, taken along line A—A of FIG. 1.

In the embodiment shown in FIGS. 1 and 2, the heat recovery device comprises a casing 4A, to which are connected three casings 4B, in communication with one another and positioned in a space 13 provided between three vertical walls of the enclosure 7 and three vertical walls of the heating apparatus. Preferably, the casings 4A and 4B are each provided with interior baffles 18 so as to increase the path of the heat exchange fluid, such that it recovers a maximum of heat during its passage in the recovery apparatus.

During the operation of the heating apparatus, the heat leaving the hearth is directed by the reverse draft phenomenon into chamber 3, and into space 13. The excess quantity of combustion air, which is not used for the combustion of the combustible, undergoes pre-heating during its passage across the coals of the hearth, which renders it ready to ignite the combustible gases, thus increasing the heating power of the apparatus and diminishing the risk of tar deposits in the evacuation conduit, in space 13 and in chamber 3.

To channel the heat flow leaving the hearth over the entire exchange surface of the recovery apparatus 4A and 4B, the combustion chamber 3 is equipped with at least one channel means. This channel means comprises a substantially vertical wall 19, which is transverse to the exchanger 4A and positioned between the upper wall of the recovery apparatus and the hearth 2. This wall is attached to the recovery apparatus 4A and to the hearth 2 by any known means and process. Wall 19, serving as a screen, serves to obstruct the communication orifice of chamber 3 with space 13 in the volume situated between the upper wall of recovery apparatus 4A and the hearth, such that the heat flow under the reverse draft action, is channeled towards the front end of the exchanger and goes around it.

Preferably, the distance separating the front end of exchanger 4A from the front wall of the heating apparatus is greater than the distance separating the lateral walls of the exchanger from the corresponding lateral walls of the apparatus, such that the major portion of the heat flux under the reverse draft goes around the front end and is then directed into the space 13. To adjust the draft, evacuation line 15 is provided with a exteriorly maneuverable damper to obstruct, more or less, the smoke passage. Evacuation conduit 5, at the outlet of enclosure 6, can likewise be provided with an exteriorly manipulable damper in order to partially or totally obstruct the communication orifice with the enclosure, so as selectively obtain the reverse draft.

Figure 3:
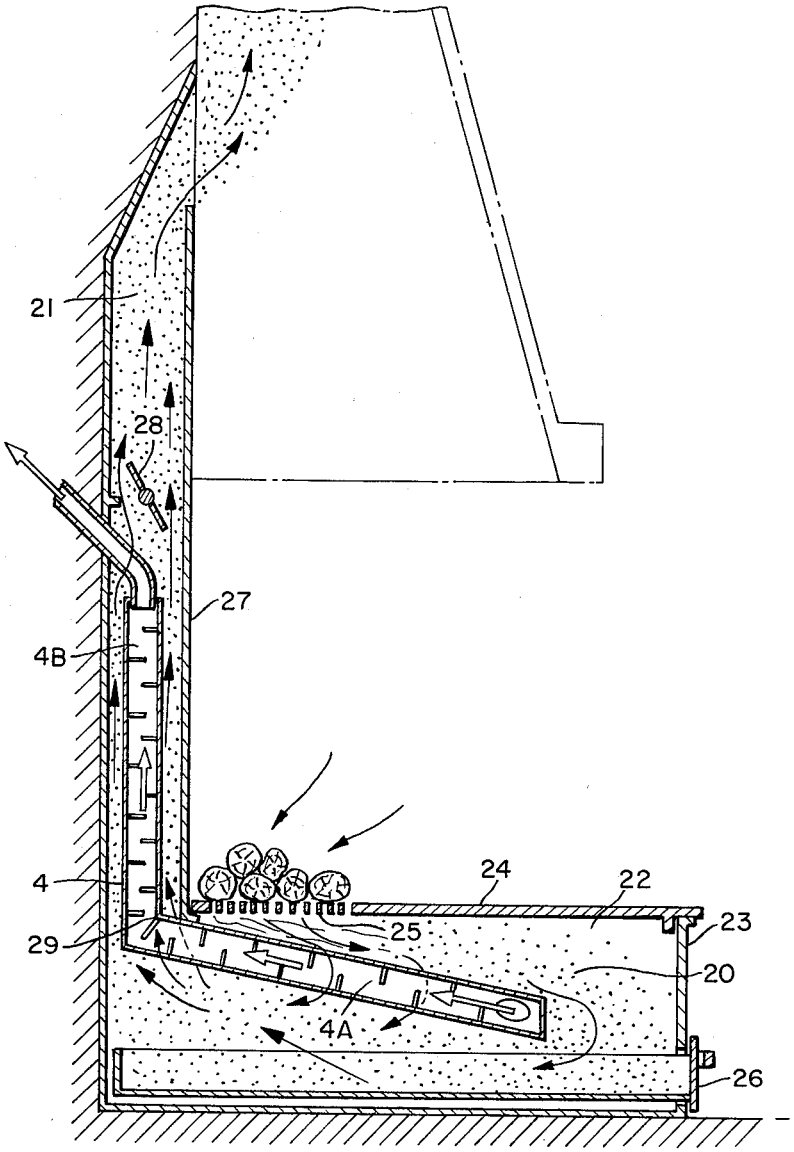
FIG. 3 is a schematic view of a fireplace according to the invention.
Figure 4:
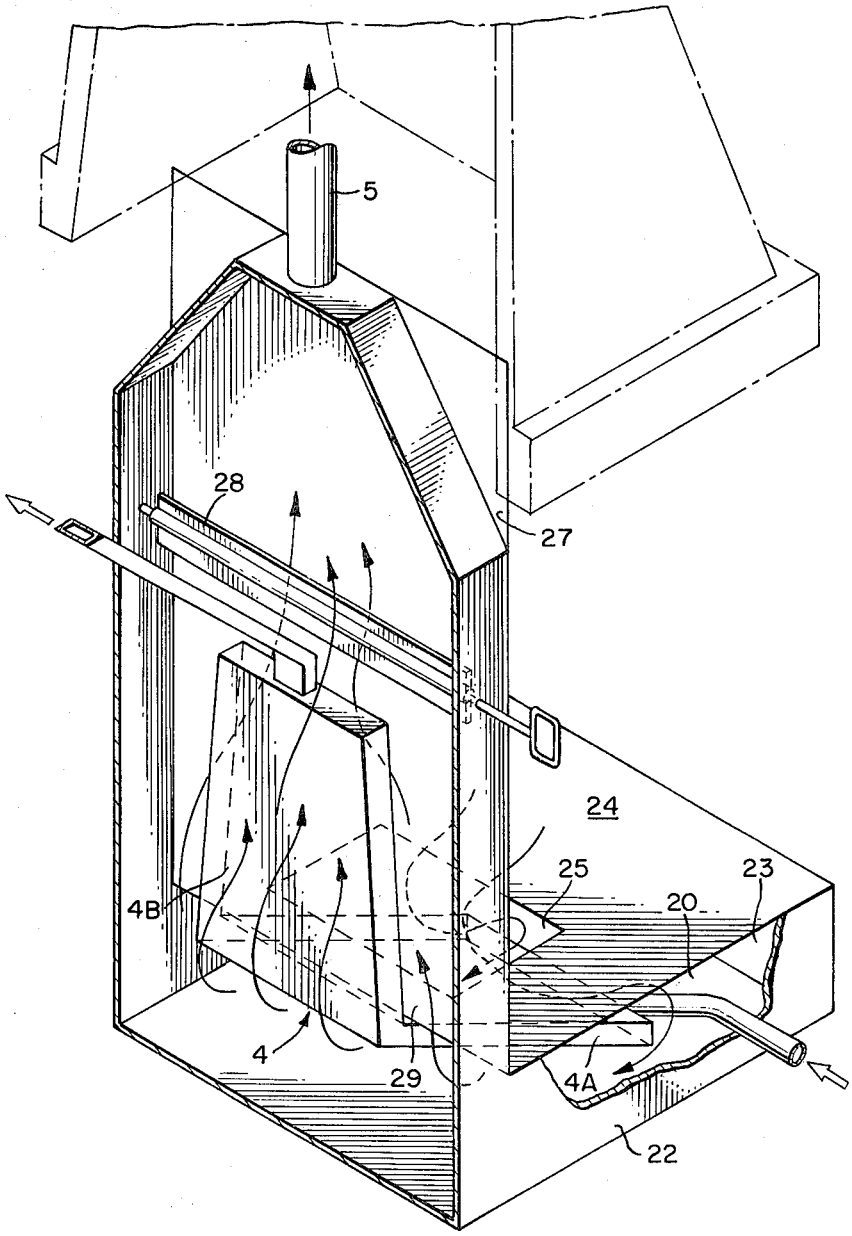
FIG. 4 is a three-quarter rear perspective view of the fireplace according to the invention.

In FIGS. 3 and 4, a heating apparatus is shown having an open hearth, such as an apartment fireplace, which functions on the reverse combustion principle, and is provided with a heat recovery device of the same type as previously described.

The fireplace according to the invention comprises a hearth under which is positioned a combustion chamber 20 in communication with a vertical conduit 21, which is placed in the rear of the fireplace opening into the hood.

The combustion chamber is defined by two lateral walls 22, and by a front wall 23; a horizontal hearth plate 24 is positioned or attached on the chamber and can have a transverse orifice for example rectangular grille 25, on which the combustible is positioned, preferably in the vicinity of the rear of the fireplace. The lateral walls 22 and front wall 23 are preferably made of refractory materials resembling the appearance of traditional fireplaces. The front wall 23 is provided with an orifice through which an ash receptacle 26 is inserted for recovery of combustion wastes; this receptacle engages the combustion chamber. The vertical conduit 21 is formed by an opening provided in the rear of the fireplace, which is covered by a vertical chimney plate 27, which is attached to the rear of the fireplace by any known means.

Heat recovery apparatus 4 is mounted in combustion chamber 20 and in conduit 21 and comprises casing 4A, positioned in the combustion chamber, and is in communication with a vertical casing 4B positioned in conduit 21. As explained previously, the casing 4A is slightly inclined towards the ash receptacle to facilitate the evacuation of combustion wastes. Upstream of casing 4B, in conduit 21, an exteriorly manipulable damper 28 is positioned which more or less obstructs the conduit to adjust the draft of the fireplace. As previously described, a plate 29 is located between the casing 4A and the hearth, forming a screen such that the heat flux leaving the hearth goes around the front end of the casing.

According to another embodiment, attempting to adapt the improvements described to existing fireplaces, the heat recovery apparatus 4 is mounted in a housing, which comprises metallic sheets assembled to one another by any known means and processes which form a combustion chamber in communication with a conduit. This housing is provided with a horizontal hearth plate, with a grille positioned or attached on the hearth of the fireplace and pressed against the rear of the fireplace.

According to another embodiment, as shown in FIG. 4, casing 4B substantially mates the isosceles trapezoidal shape whose major base constitutes its lower side, such that the said casing has, at its upper portion, a reduced exchange surface with respect to its lower portion, so as to reduce the heat losses at its upper portion.

In the apparatus previously described, the heat exchange fluid preferably comprises air, which is introduced by an accelerator or aspirator into exchanger 4. At the outlet of the casing 4B, this heated air is recovered by a channeling system and is distributed throughout a household. It is quite obvious that any other heat exchange fluid could be utilized. It is thus that one could provide a heat recovery apparatus which receives a liquid, such as water, to feed an accumulator.

On the same principle, a heat recovery apparatus can have a mixed heat exchange fluid, such as air or water. To this end, the heat recovery device could be equipped with baffles to channel the air flux and with a serpentine in which the water circulates. Furthermore, to increase the thermal yield of these apparata, in the combustion chamber and at the level of the grille a pre-heated combustion air inlet can be provided in contact with the hearth so as to facilitate ignition of the combustible gas. The heating apparatus as described functions on the reverse draft principle, allowing a substantial savings of combustible; while increasing the heat yield.

It is quite obvious that the present invention contemplates all improvements or variations without going beyond the scope of the present patent.

I claim:

1. A heating apparatus comprising:

(a) a plurality of walls;

(b) at least one combustion air inlet;

(c) a reverse-draft hearth having a grill located within a hearth plate;

(d) an ash receptacle for recovering combustion wastes;

(e) a fume evacuation outlet;

(f) a combustion chamber positioned under said hearth; and (g) a heat recovery device adapted to retain a heat-exchange fluid, said heat recovery device being positioned at least partially under said hearth, and comprising at least one casing positioned between said hearth and said ash receptacle and spaced from said apparatus walls, said casing including a rear portion which is connected to said hearth plate by means for blocking combustion gases, said apparatus including means for conducting combustion gas first above said casing, then under said casing, and means for combining said gas with smoke being evacuated through said outlet.

2. Heating apparatus in accordance with claim 1 wherein a conduit combines said combustion gas and said evacuated smoke at the rear of said hearth.

3. Heating apparatus in accordance with claim 1 further comprising a second, vertical casing connected to said at least one casing, both of said casings positioned within an enclosure which is in fluidic communication with said combustion chamber, said second, vertical casing being spaced from the walls of said heating apparatus so that hot gases within said enclosure will surround said vertical casing.

4. Heating apparatus in accordance with claim 3 wherein said heat recovery device includes a heat-exchange surface which decreases in a direction extending upwardly from said at least one casing, where heat exchange is greatest, towards said second, vertical casing, where heat exchange is lowest.

5. Heating apparatus in accordance with claim 4, wherein said second casing generally is in the shape of an isosceles trapezoid and has a heat-exchange surface which decreases from a lower portion of the second casing, which lower portion is connected to the first casing, towards an upper portion of said second casing.

6. Heating apparatus in accordance with claim 1 wherein said at least one casing is inclined, with respect to said hearth plate, towards the front of said apparatus in order to direct ashes into a removable ash receptacle.

7. Heating apparatus in accordance with claim 1 wherein said at least one casing is positioned within said combustion chamber.

8. Heating apparatus in accordance with claim 1 further comprising an enclosure between said at least one casing and said apparatus walls, and wherein a channel is provided between said combustion chamber, said enclosure, and said casing, said channel adapted to conduct heat flow, under reverse-draft action, towards the front of said apparatus.

9. Heating apparatus in accordance with claim 1 further comprising a removable ash receptacle positioned within said combustion chamber.

10. Heating apparatus in accordance with claim 1 wherein said at least one casing is positioned within said combustion chamber and adapted to be placed into contact with combustion.

11. Heating apparatus in accordance with claim 1 wherein said at least one casing includes a plurality of baffles.

12. Heating apparatus in accordance with claim 1 wherein said heat recovery device is spaced from the walls of an ash recovery receptacle and from said combustion chamber, most of said combustion gas adapted to pass about a front end of said casing.

13. Heating apparatus in accordance with claim 1 wherein a grill bounds an upper portion of the combustion chamber.

14. Heating apparatus in accordance with claim 2 wherein said enclosure includes at least one selectively operable damper for controlling gas and smoke flow through said evacuation outlet.

15. Heating apparatus in accordance with claim 1 further comprising a plate valve positioned within said air inlet for controlling the introduction of air into the apparatus.

* * * * *

UNITED STATES PATENT AND TRADEMARK OFFICE

CERTIFICATE OF CORRECTION

PATENT NO. : 4,397,293

DATED : August 9, 1983

INVENTOR(S) : Thierry PIBERNAT

It is certified that error appears in the above-identified patent and that said Letters Patent is hereby corrected as shown below:

In Column 1, line 23, after "cannot" insert ---,---.

In Column 1, line 37, after "hood" insert ---,---.

In Column 3, line 43, after "22" delete ---,---.

In Column 3, line 45, after "orifice" insert ---,---.

Signed and Sealed this

*Twenty-fourth* Day of *April 1984*

[SEAL]

*Attest:*

GERALD J. MOSSINGHOFF

*Attesting Officer*

*Commissioner of Patents and Trademarks*